US008737827B2

(12) United States Patent
Zack et al.

(10) Patent No.: US 8,737,827 B2
(45) Date of Patent: May 27, 2014

(54) SAUNA HEATING ELEMENT WITH HIGH EMISSIVITY COATING

(75) Inventors: Aaron M. Zack, Overland Park, KS (US); Ronald James Lewarchik, Brighton, MI (US)

(73) Assignee: Sunlighten, Inc., Overland Park, KS (US)

( * ) Notice: Subject to any disclaimer, the term of this patent is extended or adjusted under 35 U.S.C. 154(b) by 1005 days.

(21) Appl. No.: 12/787,892

(22) Filed: May 26, 2010

(65) Prior Publication Data

US 2011/0293253 A1 Dec. 1, 2011

(51) Int. Cl.
*H05B 3/20* (2006.01)
*F24D 19/02* (2006.01)

(52) U.S. Cl.
USPC ..... 392/434; 392/407; 392/432; 392/433; 219/543

(58) Field of Classification Search
None
See application file for complete search history.

(56) References Cited

U.S. PATENT DOCUMENTS

| | | | |
|---|---|---|---|
| 3,755,090 | A | 8/1973 | Jackson |
| 6,221,441 | B1 | 4/2001 | Emch |
| 6,333,372 | B1 | 12/2001 | Tomihashi |
| 6,476,119 | B1 | 11/2002 | Kucera |
| 2003/0191230 | A1 | 10/2003 | Ladatto |
| 2008/0292293 | A1 | 11/2008 | Song |
| 2010/0047467 | A1 | 2/2010 | Nesbitt |

OTHER PUBLICATIONS

The International Search Report and Written Opinion for PCT/US2011/038145; filed May 26, 2011.

*Primary Examiner* — Thor Campbell
(74) *Attorney, Agent, or Firm* — Shook, Hardy & Bacon L.L.P.

(57) ABSTRACT

A high emissivity coating applied to a sauna heating element and a method for fabricating a sauna heating element with a high emissivity coating is described. In one illustrative embodiment, a sauna heating element comprises a substrate, and a film coating applied to the substrate, the film coating applied as a first liquid layer and a second powder layer. In another illustrative embodiment, a process is provided for fabricating a sauna heating element with a high emissivity coating.

21 Claims, 5 Drawing Sheets

SAUNA HEATING ELEMENT WITH HIGH EMISSIVITY COATING

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter. The present invention is defined by the claims below but, summarily, embodiments of the present invention are directed toward the products and process for manufacturing a sauna heating element. More particularly, the present invention the sauna heating element comprises a high emissivity coating composition.

A high emissivity coating composition applied to a sauna heating element in accordance with the present invention may be used to produce an IR sauna experience. The high emissivity coating composition preferably has an emissivity of 98% or greater but it also safe for human contact. Previously, high emissivity coatings may reach temperatures that cause burns if in contact with skin. All of the chemicals used in the high emissivity coating composition are FDA approved which ensures that the coating is non-toxic. Also, using a coating composition applied that has a high emissivity to a sauna heating element is a more efficient heat source and therefore, consumes less energy.

A first aspect of the present invention relates to a sauna heating element including a substrate in contact with a heating element, and a film coating applied to the substrate. The substrate is in operable contact with a heating element that heats when voltage is applied across the heating element and warms the substrate to a first temperature. The film coating includes a first liquid layer and a second powder layer, the first liquid layer comprising a polyamide-imide type coating resin, a solvent and a black ceramic pigment. The second powder layer comprising black ceramic pigment is distributed evenly over the first liquid layer. The first liquid layer has a dry film thickness greater than about 1.0 mils and less than about 5.0 mils. A mil is a unit of distance equal to 0.001 inch: a "milli-inch," in other words. Mils are used, primarily in the U.S., to express small distances and tolerances in engineering work. One mil is exactly 25.4 microns, just as one inch is exactly 25.4 millimeters. The second powder layer is evenly applied to the first liquid layer to obtain a weight of black copper chrome powder of from about 5 to 15 grams per square foot of surface area. After heating the first liquid layer and the second powder layer from about 150 degrees Celsius to about 220 degrees Celsius, the film coating over the substrate is a high emissive coating that provides high emissivity and high heat stability while being safe for use with humans in a sauna environment and is FDA approved.

In a second aspect, a sauna heating element that is made by the process of preparing a substrate prior to application of film coating to improve adhesion of the film coating; applying a first liquid layer comprising a polyamide-imide type coating resin, a solvent, and a black ceramic pigment over the substrate; applying a second powder layer evenly distributed over the first liquid layer, the second powder layer comprising black ceramic pigment; and after applying both the first liquid layer and the second powder layer, curing the first liquid layer and second powder layer to form the film coating over the substrate.

In a third aspect a process of fabricating a sauna heating element is provided by preparing a substrate prior to application of a film coating to improve the film coating adhesion; applying a first liquid layer over the substrate comprising a polyamide-imide type coating resin, a solvent and a black ceramic pigment; applying a second powder evenly over the first liquid layer, the second powder layer comprising black ceramic pigment, the first liquid layer has a dry film thickness greater than about 1.0 mils and less than about 5.0 mils. The powder layer is applied evenly to the first liquid layer to obtain a weight of black copper chrome powder of about 5 to 15 grams per square foot of surface area. After heating the first liquid layer and the second powder layer from about 150 degrees Celsius to about 220 degrees Celsius, the film coating over the substrate is a high emissive coating that provides high emissvity and high heat stability while being safe for use with humans in a sauna environment and is FDA approved.

BRIEF DESCRIPTION OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Figure 1:
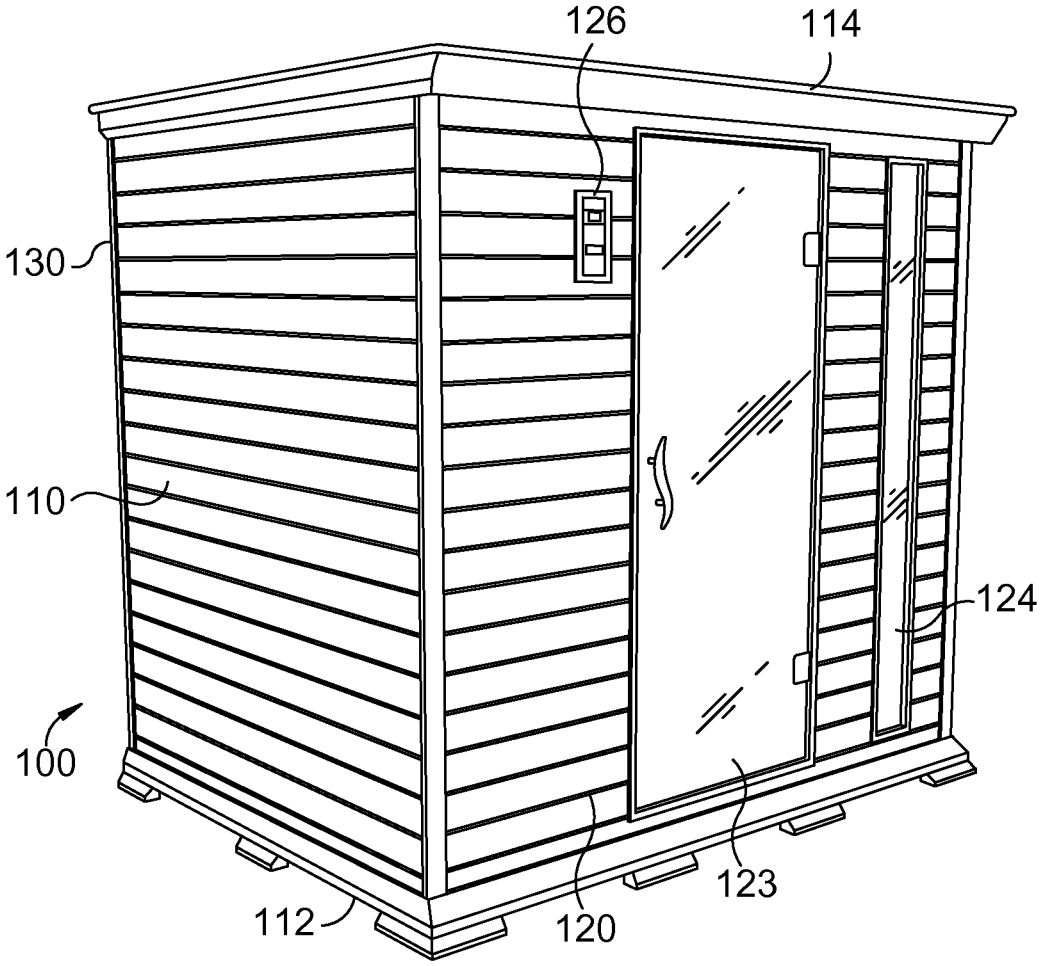
FIG. 1 is a perspective view of a sauna in accordance with an embodiment of the present invention.

Referring to FIG. 1, an exemplary sauna 100 is illustrated and generally includes a base panel 112, upright side panels 110 extending upwardly from base panel 112, a top panel 114 surmounting the side panels 110 so as to define a sauna enclosure. The sauna illustrated in FIG. 1 also includes a rear panel 130 and a front panel 120 having a door 123 disposed therein. It will be appreciated by those skilled in the art that the door 123 may be made of any number of various materials such as, for example, glass, wood, or particle board. The front panel 120 has a window 124 disposed between the door 123 and one of the side panels 110. It will be further appreciated by those skilled in the art that the panels and other components of a sauna 100 could be built using wood, metal, ceramics, or any other material available.

In the illustrated embodiment, an external control panel 126 for controlling various sauna features such as, for example, heating, lighting, or entertainment devices. In other embodiments, a sauna may not have an external control panel 126, but only an internal control panel, as discussed below. In further embodiments, a sauna may be provided with an external control panel that is not attached to the sauna, but rather is at a remote location such as, for example, a desk or control station in a health club. All of these arrangements, and all combinations thereof, are intended to be within the ambit of the saunas described herein.

Although the illustrated sauna has a generally rectangular configuration, it is entirely within the ambit of the present invention to provide other sauna configurations. For example, in one embodiment a sauna may be provided that has upright panels extending upwardly from the base panel at an angle so as to present a different polygonal shape. In another embodiment, a sauna may be configured so that it can fit comfortably in a corner of a room such as, for example, the Signature™ Corner sauna available from Sunlighten Saunas, Inc. of Overland Park, Kans. In still a further embodiment, a sauna may be configured as a circular shaped modular sauna with interconnected panels. In one embodiment, a sauna may be provided that is configured with a semi-hemispherical shape for accommodating a single user such as, for example, the Solo System® available from Sunlighten Saunas, Inc. of Overland Park, Kans.

Figure 2:
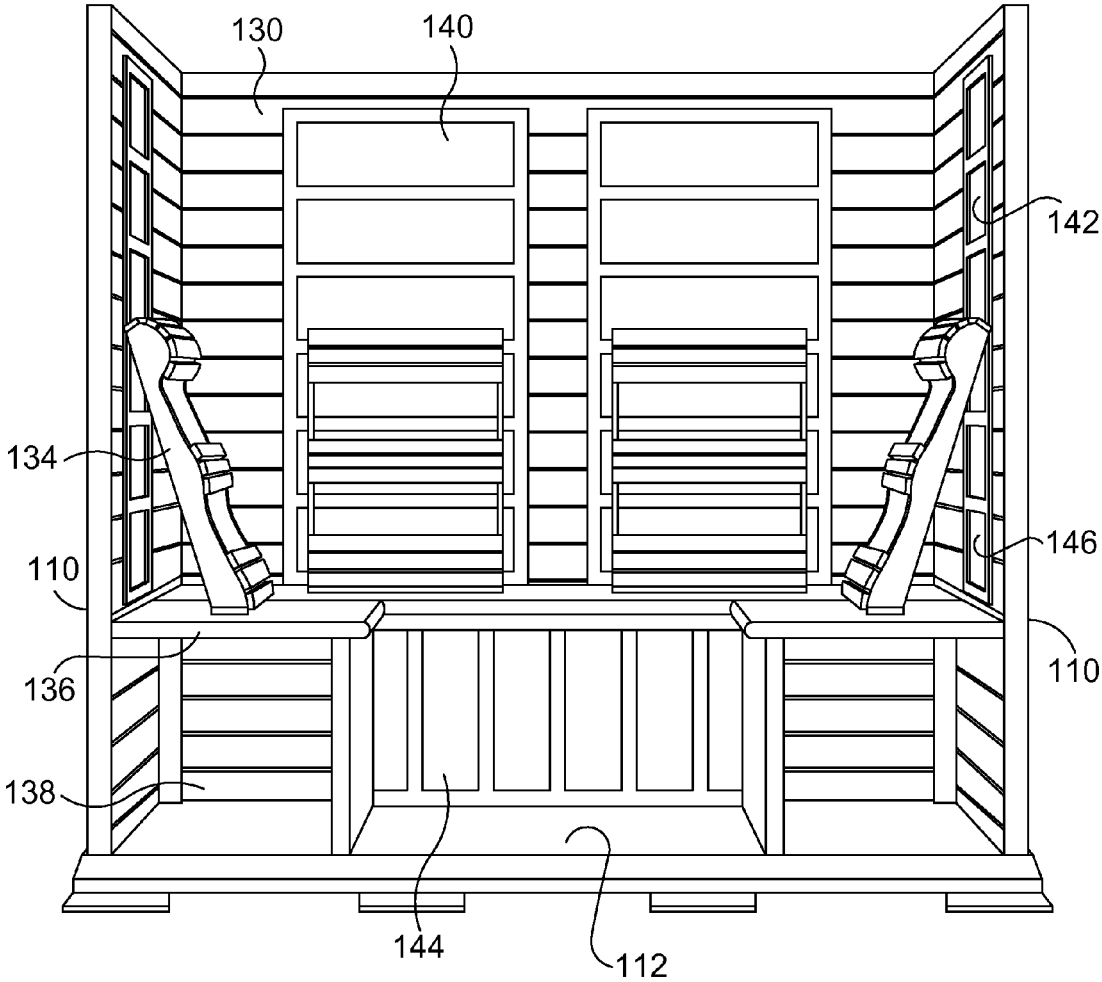
FIG. 2 is a cut-away front view of a sauna in accordance with an embodiment of the present invention.

Turning now to FIG. 2, a cut-away front view of a sauna such as the sauna 100 illustrated in FIG. 1 is shown. As illustrated, in one embodiment of the present invention, the sauna 100 may include one or more seating structures 136, such as benches, chairs, or other seating structures. The seating structures 136 may be disposed adjacent to any of the various internal walls of the sauna such as for example, the side walls 110 or the back wall 130. In various embodiments, such as the one depicted in FIG. 2, the sauna may include open spaces 138 disposed underneath the seating structures 136 and adjacent the interior walls 110 or 130. The open spaces 138 may be left open, used for storage, used to house other sauna feature devices, such as, for example, a computing device as described below, or may be used for any other purpose and in any other manner known in the art. In the illustrated embodiment, the sauna 100 is also provided with backrests 134 disposed on top of the seating structures 136 for supporting a user in an upright, seated position.

Additionally, the sauna 100 is equipped with heat sources 140, 142, 144, 146, which are operable to heat the enclosure. The heat sources 140, 142, 144, 146 are preferably configured to emit infrared radiation at varying wavelengths within the sauna so as to provide both heating and desirable IR treatment. In some embodiments, the heat sources may be adjustable to emit infrared radiation at any wavelength within the infrared wavelength spectrum such as, for example, near infrared, mid infrared, or far infrared. Those ordinarily skilled in the art will appreciate that such heat sources 140, 142, 144, 146 provide a dry sauna with infrared treatment. As described further herein, IR emitters in accordance with the present invention may be used to create a "traditional" sauna experience, either by itself or in conjunction with a dry IR sauna experience. Additionally, certain wavelength settings may be adapted for particular treatment types such as, for example, detoxification, weight loss, pain management, and the like.

However, one of skill in the art will note that certain aspects of the present invention are not limited to such a sauna (e.g., certain principles apply to other types of saunas, such as steam saunas) or heaters (e.g., traditional coil heaters, etc.) or even at all. Similarly, although the exemplary embodiment illustrated in FIG. 2 shows a plurality of heat sources, it will be appreciated that other embodiments of the present invention may include saunas with a single heat source such as, for example, a single infrared heat source, a heated rock heat source, or a wire heat source.

With continued reference to FIG. 2, the heat sources 140, 142, 144, 146 may be configured such that individual heat sources 140, 142, 144, 146 or combinations of heat sources 140, 142, 144, 146 may be selected to output wavelengths of radiation that are different than wavelengths of radiation emitted by other heat sources 140, 142, 144, 146. Such a configuration may be optimized to achieve a zone-heating effect, where one or more heat sources 140, 142, 144, 146 is situated in a zone that corresponds to a particular region on a user's body, thus providing a mechanism for concentrating different levels of heat to different parts of the user's body. In an embodiment, one or more heat sources corresponding to one or more zones may be turned off such that no heat is emitted in those zones. It will be readily appreciated by those skilled in the art that such arrangements may be advantageous for various therapeutic reasons.

For example, in the embodiment illustrated in FIG. 2, some heat sources 144 may be positioned in a zone corresponding to a user's calf region (i.e., the lower part of the leg). Other heat sources 146 may be positioned in a zone corresponding to a user's lower-back region, and further heat sources 140, 142 may be positioned in zones corresponding to various other regions of a user's back. Thus, for example, if a user wishes to apply more heat to a sore calf muscle than to the rest of the user's body, the user may be able to select a higher output from heat source 144, while selecting a lower output for heat sources 140, 142, and 146. In various embodiments, fewer heat sources than those illustrated in FIG. 2 may be used, and in various other embodiments, more heat sources than those illustrated in FIG. 2 may be used. Additionally, heat sources may be configured in any number of ways to define zones that correspond to any number of regions of a user's body. As will be readily appreciated by those skilled in the art, any number of various combinations of settings and configurations for the heat sources are contemplated within this description.

Figure 3A:
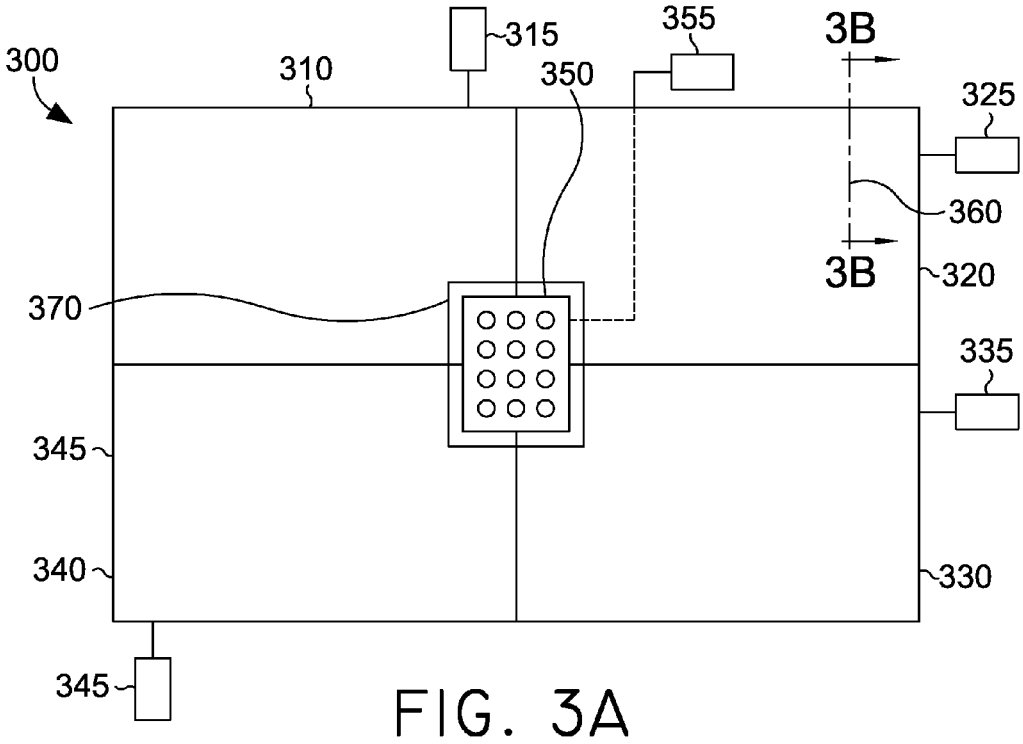
FIG. 3A is a view of an exemplary IR source in accordance with the present invention.

Referring now to FIG. 3A, an infrared source 300 in accordance with the present invention is illustrated. Infrared source 300 may comprise a plurality of sections, such as first section 310, second section 320, third section 330, and fourth section 340. Each section may comprise an electronically discreet heating element. A heating element may be, for example, a flexible high-resistance polyimide material and a high emissivity coating may cover the surface of the polyimide substrate.

Figure 3B:
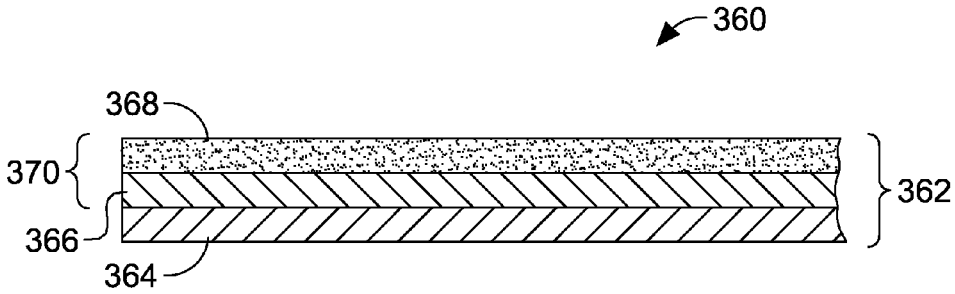
FIG. 3B is a cross-sectional view of one exemplary sauna heating element with a film coating in accordance with the present invention.

Further details of a sauna heater element, such as may be used for first heater element 310, second heater element 320, third heater element 330, and/or fourth heater element 340, are illustrated in FIG. 3B. FIG. 3B illustrates a cross-sectional view of a sauna heater element 360 that comprises a substrate 364 and a film coating 370. The film coating formed with a first liquid layer 366 and a second powder layer 368 during fabrication. The first liquid layer 366 may include polyamide-imide (PAI) type coating resin, a solvent and a black ceramic pigment. A PAI type coating resin offers long term temperature resistance, works in a liquid or solid composition, is FDA approved, readily dissolved in N-methylpyrrolidone (NMP), and may be used to disperse pigments. In a preferred embodiment, the first liquid layer of the film coating comprises a ratio of PAI type coating resin to black ceramic pigment of about 1.0:0.5 to about 1.0:3.0. A suitable solubilizer solvent such as N-methylpyrrolidone (NMP) can be used as a solubilizer for the PAI type coating resin. Depending on the liquid viscosity desired, NMP can comprise between about 1 percent and about 75 percent of the coating composition prior to application. Of the solid material, an acceptable range for the amount of PAI type coating resin is between about 20 percent and about 75 percent and depends on the application method used.

Black ceramic pigments are well suited for this application due to their heat stability, chemical inertness, FDA approvability of certain black ceramic pigments, low oil absorption, and high emissivity. Ceramic pigments are also known as "mixed metal oxide pigments" because they are oxidized or manufactured at temperatures which exceed 1000 degrees Fahrenheit. Due to the fact that ceramic pigments are fully oxidized, they can be used in many high heat applications. A copper chrome black, such as Heubach HD 953-1, is an example of the type of black ceramic pigment that may be used. In a preferred embodiment, the black ceramic pigment may have an average primary particle size of 0.3 micrometer. An acceptable range of the amount of the black ceramic pigment within the first liquid layer is between on solids is between about 50 percent and about 80 percent.

The second powder layer 368 may include an additional layer of the ceramic black pigment. An acceptable range of the amount of black ceramic pigment in the second powder layer is between about 5 and about 15 grams per square foot of the surface of the first liquid layer. Substrate 364 may comprise Cirlex, which is a proprietary, all polyimide material, comprising layers of DuPont Kapton®, for example. If used, Cirlex may comprise a thickness of from about 0.203 mils to 3.175 mils. By way of further example, substrate 364 may comprise etched foil or wound wire between layers of fiberglass reinforced silicone rubber. Yet, a further example of a substrate 364 is an etched foil layer between layers of mica. Of course, further types of materials may be used for substrate 364 without departing from the scope of the present invention.

The first liquid layer 366 and the second powder layer 368 are cured over the substrate 364 to form a single coating layer. There are several different methods to achieve the single coating layer. One example is after applying the first liquid layer 366, applying the second powder layer 368 and then curing the two layers over the substrate using a temperature between about 150 degrees Celsius and about 220 degrees Celsius. Another example is after applying the second powder layer 368 over the first liquid layer 366, heating up the two layers over the substrate 364 to enable the embedding of the second powder layer 368 into the first liquid layer 366. Then, cure the two layers at a temperature between about 150 degrees Celsius and about 220 degrees Celsius.

Referring again to FIG. 3A, one of skill in the art will further realize that sections as illustrated in FIG. 3A may comprise various types of heating elements. As illustrated in FIG. 3A, first section 310 may be controlled using a first thermocouple 315, second section 320 may be controlled using a second thermocouple 325, third section 330 may be controlled using a third thermocouple 335, and fourth section 340 may be controlled using a fourth thermocouple 345. The use of thermocouples may be advantageous in providing a finer control of the radiative temperature of the section it controls than a thermostat, but a thermostat or other type of control device may be utilized. As illustrated in FIG. 3A, infrared source 300 may further comprise an additional heating zone 350 controlled by a fifth thermocouple 355, although other types of heat control devices may be used. As illustrated in FIG. 3A, fifth heating zone, 350 comprises an LED array. For example, LED array 350 may emit far-infrared radiation under the control of thermocouple 355. As illustrated in FIG. 3A, different types of emitters may be used in combination to provide different types of infrared spectrum simultaneously. For example, first section 310 may be set (by the user, by an administrator, by a software program, or by other sources) to emit infrared radiation in the near-infrared spectrum. Meanwhile, second heater section 320 and third heater section 330 may be set (by similarly various means as the first section 310) to emit infrared radiation in the mid-infrared spectrum. Fourth section 340 may be deactivated for purposes of a given infrared application. Meanwhile, fifth section 350 may be activated (similarly to first section 310) to emit infrared radiation in the far-infrared portion of the spectrum. One of skill in the art will appreciate that any given peak infrared wavelength will correspond to a surface temperature of the emitting heater section. In such a fashion, a user may obtain a spectrum having a desired peak or peaks of infrared radiation at one or more desired wavelengths, as well as a peak desired power of radiation. While infrared sources such as IR source 300 may be particularly useful in saunas, as described herein, one of skill in the art will appreciate that a tunable infrared source such as IR source 300 may be useful in a number of applications.

Overall, infrared source 300 may be approximately 25.5 inches long and approximately 13.5 inches high. Fifth heating section 350 may comprise approximately a 4 inch by 6.5 inch section approximately centered within infrared source 300. A space 370 of approximately 1 inch may be provided between fifth heating section 350 and first heating section 310, second heating section 320, third heating section 330, and fourth heating section 340 to facilitate the operation of fifth heating section 350 at a lower operating temperature than first heating section 310, second heating section 320, and third heating section 330, and fourth heating section 340. The power density of one or more section of infrared source 300 may be selected based upon the cooling, load of the heating section. The desired power density may impact the shape and density of copper traces in the polyimide heater example illustrated in FIG. 3B. For sauna applications, in which the cooling load may be limited air in contact with the heating section, a desirable power density may be 2.5 w/in$^2$ at 120 Vrms. Individual heating elements of infrared source 300 may, optionally, be thermal limited to a maximum surface temperature of 160° C. If fifth heating section 350 is an LED array, a resistor, such as a 26Ω drive resistor may be used to limit current to the LED array. The drive resistor, being a current limiting mechanism, may dissipate excess energy through ohmic heat loss. The drive resistor may be integrated directly onto a polyimide heating layer as an appropriately sized metallic trace.

Figure 4:
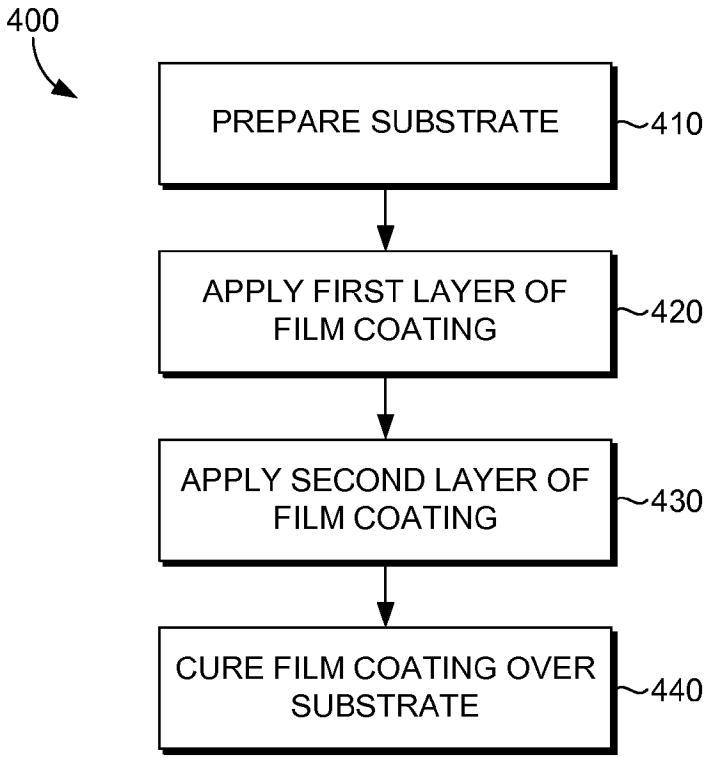
FIG. 4 is a block diagram showing a method for applying a high emissivity coating to a sauna heating element in accordance with an embodiment of the present invention.

Turning now to FIG. 4, a flow diagram is shown illustrating an example embodiment of a method 400 for applying a high emissivity coating to a sauna heating element in accordance with an embodiment of the present invention. At step 410, the substrate is prepared. The substrate may be cleaned and prepared to receive the film coating in preparation to step 410. At step 420, the first liquid layer of the film coating is applied to the substrate. As mentioned above, the first layer of the film coating may be a liquid layer including a PAI type coating resin, a solvent and a black ceramic pigment. First liquid layer application step 420 may use, but is not limited to, brushing, spraying, rolling (direct or reverse), coil coating, sheet coating, melt flowing, dipping or curtain coating, electrocoating, vacuum metalizing, sputtering, chemical vapor deposition, flame spraying, or plasma spraying. The preferred method of application of the first layer is via direct contact, such as direct rolling or brushing, because it provides the greatest efficiency of material usage as very little paint is lost in the process. At step 430, the second powder layer of the film coating is applied. As mentioned above, the second powder layer application step 430 may apply a layer containing additional black ceramic pigment. The black ceramic pigment may be evenly distributed over the first liquid layer. The dry film thickness of the first liquid layer may be greater than about 1.0 mils and less than about 5.0 mils. Second powder layer application step 430 may use, but is not limited to, dusting, spraying or sifting over the first liquid layer. At step 440, the film coating may be cured over the substrate. The film coating cure step 440 may use temperatures between about 150 degrees Celsius and about 220 degrees Celsius, and the overall thickness of the cured film coating after step 440 may be more than about 1.0 mils and less than about 1.5 mils.

Figure 5:
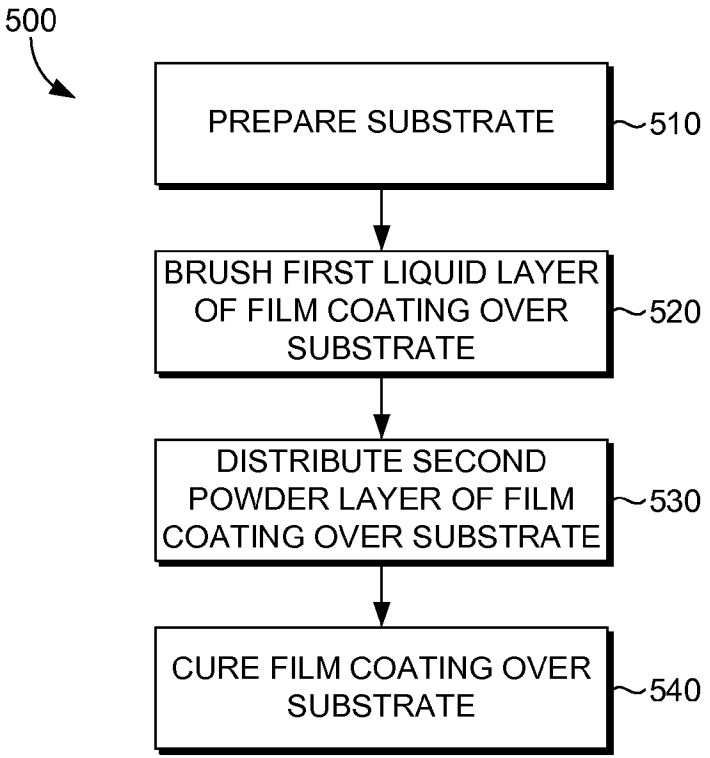
FIG. 5 is a flow diagram showing another method for applying a high emissivity coating to a sauna heating element in accordance with an embodiment of the present invention.

Referring now to FIG. 5, another flow diagram is shown illustrating an example embodiment of a method 500 for applying a high emissivity coating to a sauna heating element in accordance with an embodiment of the present invention. At step 510, the substrate is prepared. The substrate may be cleaned and prepared to receive the film coating in preparation step 510. At step 520, the first liquid layer of the film coating is brushed over the substrate. At step 530, the second powder layer of the film coating is distributed over the first layer of the film coating. Second powder layer application step 530 may use, but is not limited to, dusting, spraying or sifting. At step 540, the film coating may be cured over the substrate. The film coating cure step 440 may use temperatures between about 150 degrees Celsius and about 220 degrees Celsius, and the overall thickness of the cured film coating after step 440 may be more than about 1.0 mils and less than about 1.5 mils.

Figure 6:
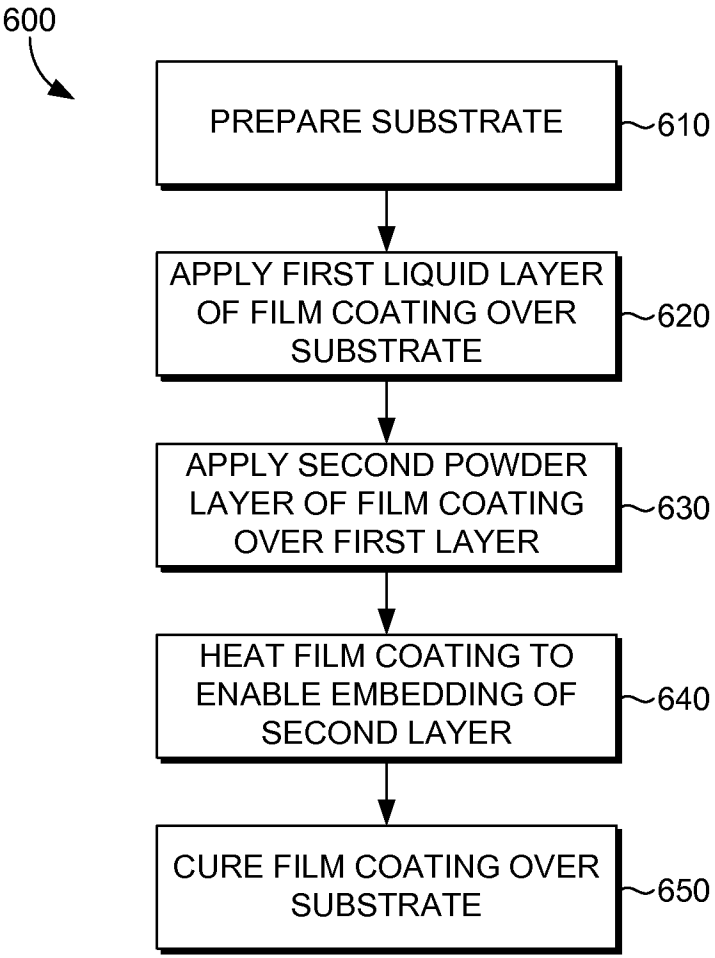
FIG. 6 is a flow diagram showing another method for applying a high emissivity coating to a sauna heating element in accordance with an embodiment of the present invention.

Referring now to FIG. 6, another flow diagram is shown illustrating an example embodiment of a method 600 for applying a high emissivity coating to a sauna heating element in accordance with an embodiment of the present invention. At step 610, the substrate is prepared which may include cleaning and preparing the substrate to receive the film coating in preparation step 610. At step 620, the first liquid layer of the film coating is applied over the substrate. At step 630, the second powder layer of the film coating may be distributed evenly over the first liquid layer. At step 640, the film coating may be heated to enable embedding of the second layer within the first layer. The second powder layer embedded step 640 may use temperatures between about 100 degrees Celsius and about 220 degrees Celsius. Embedding the second layer within the first layer provides higher emissivity. At step 650, the film coating may be cured over the substrate. The film coating cure step 650 may use temperatures between about 150 degrees Celsius and about 220 degrees Celsius. One of skill in the art will appreciate however, that method 600 and the other systems and methods in accordance with the present invention may be utilized in a variety of scenarios and for a variety of purposes other than a sauna application.

Embodiments of the present invention provide for a sauna integrated within a smart home environment such that various settings associated with the sauna can be controlled from various locations in the home, or even from locations remote from the home. Other embodiments provide for a sauna that is integrated within a network of saunas or other devices. Still further embodiments provide for a sauna having any combination or all of the various features described herein.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well-adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. A sauna heating element including a high-emissivity coating, the sauna heating element comprising:

a heating component that increases in temperature when voltage is applied across the heating component;

a substrate in operable contact with the heating component, such that when the heating component increases in temperature, it warms the substrate to a first temperature; and a film coating in contact with the substrate, the film coating comprising:

a liquid layer that is in contact with the substrate and has a dry film thickness of about 1.0 mil to about 5.0 mils, the liquid layer comprising:

a polyamide-imide type coating resin, a solvent, and a first black ceramic pigment having an average primary particle size of 0.1 micrometer to 10 micrometers, wherein the ratio of the polyamide-imide type coating resin to the first black ceramic pigment is about 1.0:0.5 to about 1.0:3.0, and a powder layer that is in contact with the liquid layer, the powder layer comprising a second black ceramic pigment having a uniform surface area density of about 5 grams of the second black ceramic pigment per square foot of the film coating to about 15 grams of the second black ceramic pigment per square foot of the film coating.

2. The sauna heating element of claim 1, wherein the liquid layer and the powder layer are cured to form the film coating at a temperature between about 150 degrees Celsius and about 220 degrees Celsius.

3. The sauna heating element of claim 1, wherein the solvent is N-methylpyrrolidone.

4. The sauna heating element of claim 1, wherein the first black ceramic pigment and the second black ceramic pigment comprise copper chromite black spinel.

5. The sauna heating element of claim 1, wherein the solvent comprises N-methylpyrrolidone.

6. A method of making a sauna heating element having a high-emissivity coating, the method comprising:

providing a substrate for an application of a film coating, wherein the substrate is in operable contact with a heating component such that the heating component warms the substrate to a first temperature when voltage is applied across the heating component;

applying a liquid layer to the substrate, the liquid layer comprising a polyamide-imide type coating resin, a solvent, and a first black ceramic pigment, wherein the first black ceramic pigment has an average primary particle size between 0.1 micrometer and 10 micrometers, and wherein the liquid layer has a dry film thickness that is greater than about 1.0 mils and less than about 5.0 mils;

applying a powder layer to the liquid layer, the powder layer comprising a second black ceramic pigment, wherein the powder layer has a uniform surface area density of about 5 grams of the second black ceramic pigment per square foot of the liquid layer applied to the substrate to about 15 grams of the second black ceramic pigment per square foot of the liquid layer applied to the substrate; and after applying the liquid layer and the powder layer, curing the liquid layer and the powder layer to form the film coating over the substrate at a temperature between about 150 degrees Celsius and about 220 degrees Celsius.

7. The sauna heating element made by the process of claim 6, wherein curing the film coating further comprises curing the film coating at a temperature of about 160 degrees Celsius.

8. The sauna heating element made by the process of claim 6, wherein the application of the liquid layer is selected from the group consisting of brushing, spraying, rolling, printing, and applying with a doctor blade the liquid layer over the substrate.

9. The sauna heating element made by the process of claim 6, wherein applying the powder layer further comprises sifting the powder layer evenly over the liquid layer.

10. The sauna heating element made by the process of claim 6, wherein applying the powder layer further comprises spraying the powder layer evenly over the liquid layer.

11. The sauna heating element made by the process of claim 6, wherein the liquid layer of the film coating further comprises a ratio of solids of the polyamide-imide type coating resin to the first black ceramic pigment of about 0.35:1.00 and the solvent is N-methylpyrrolidone.

12. The sauna heating element made by the process of claim 6, wherein the dry film thickness of the liquid layer is more than about 1.0 mils and less than about 1.5 mils.

13. A process of fabricating a sauna heating element, the process comprising:

providing a substrate for an application of a film coating, wherein the substrate is in operable contact with a heating component such that the heating component warms the substrate to a first temperature when voltage is applied across the heating component;

applying a liquid layer to the substrate, the liquid layer comprising a polyamide-imide type coating resin, a solvent, and a first black ceramic pigment, wherein the first black ceramic pigment has an average primary particle size of 0.3 micrometer, and wherein the liquid layer has a dry film thickness that is greater than about 1.0 mils and less than about 5.0 mils;

applying a powder layer to the liquid layer, the powder layer comprising a second black ceramic pigment, wherein the powder layer has a uniform surface area density of about 5 grams of the second black ceramic pigment per square foot of the liquid layer applied to the substrate to about 15 grams of the second black ceramic pigment per square foot of the liquid layer applied to the substrate;

after applying the liquid layer and the powder layer, curing the liquid layer and the powder layer to form the film coating over the substrate at a temperature between about 150 degrees Celsius and about 220 degrees Celsius, wherein the thickness of the cured film coating is more than about 1.0 mils and less than or equal to about 1.5 mils.

14. The process of claim 13, wherein curing the film coating further comprises curing the film coating at a temperature of about 160 degrees Celsius.

15. The process of claim 13, wherein applying the liquid layer further comprises brushing the liquid layer over the substrate.

16. The process of claim 13, wherein applying the liquid layer further comprises spraying the liquid layer over the substrate.

17. The process of claim 13, wherein applying the powder layer further comprises sifting the powder layer evenly over the liquid layer.

18. The process of claim 13, wherein applying the powder layer further comprises spraying the powder layer evenly over the liquid layer.

19. The process of claim 13, wherein the liquid layer of the film coating further comprises a ratio of solids of the polyamide-imide type coating resin to the first black ceramic pigment of about 0.35:1.00 and the solvent is N-methylpyrrolidone.

20. The process of claim 15, wherein the applying the powder layer further comprises applying the powder layer such that the power layer has a uniform surface area density of about 5 grams of the second black ceramic pigment per square foot of the liquid layer applied to the substrate to about 10 grams of the second black ceramic pigment per square foot of the liquid layer applied to the substrate.

21. The process of claim 15, wherein the coating curing further comprises curing the liquid layer and the powder layer at about 160 degrees Celsius.

* * * * *